US006361311B1

(12) United States Patent
Smith

(10) Patent No.: US 6,361,311 B1
(45) Date of Patent: Mar. 26, 2002

(54) LOW BURNING CANDLE

(75) Inventor: Nigel Peter Smith, Wellington (GB)

(73) Assignee: Globol Chemicals (UK) Limited, Bampton (GB)

( * ) Notice: Subject to any disclaimer, the term of this patent is extended or adjusted under 35 U.S.C. 154(b) by 0 days.

(21) Appl. No.: 09/561,327

(22) Filed: Apr. 28, 2000

Related U.S. Application Data

(63) Continuation of application No. PCT/CB98/03272, filed on Nov. 3, 1998, now abandoned.

(30) Foreign Application Priority Data

Nov. 5, 1997 (GB) ..... 9723416

(51) Int. Cl.[7] ..... F21V 35/00; C11C 5/00
(52) U.S. Cl. ..... 431/291; 431/289
(58) Field of Search ..... 431/206, 291, 431/289, 343; 126/45

(56) References Cited

U.S. PATENT DOCUMENTS

| | | | | | |
|---|---|---|---|---|---|
| 1,309,545 | A | * | 7/1919 | Reicher | 431/291 |
| 1,320,109 | A | * | 10/1919 | Wooster | 431/291 |
| 1,344,446 | A | * | 6/1920 | Engman | 431/291 |
| 3,428,409 | A | * | 2/1969 | Summers | 431/289 |
| 4,381,914 | A | | 5/1983 | Ferguson | |
| 5,842,850 | A | | 12/1998 | Pappas | |
| 6,062,847 | A | * | 5/2000 | Pappas | 431/291 |

FOREIGN PATENT DOCUMENTS

| | | | | |
|---|---|---|---|---|
| AU | 79063 | * | 3/1919 | 431/291 |
| CH | 212049 | * | 10/1940 | 431/291 |
| DE | 3509307 | * | 9/1986 | 431/289 |
| DE | 8911631 | | 11/1989 | |
| DE | 4203644 | | 8/1993 | |
| GB | 1430 | * | of 1910 | 431/291 |
| GB | 2080514 | * | 2/1982 | 431/289 |
| WO | WO 92/08776 | | 5/1992 | |
| WO | WO 99/23416 | * | 5/1999 | |

* cited by examiner

*Primary Examiner*—Carl D. Price
(74) *Attorney, Agent, or Firm*—Nixon Peabody LLP

(57) ABSTRACT

A low-burning candle comprises a body of fuel (1) having top (1*a*) and base (1*b*) regions, a glass enclosure (2), a central wick (3) and a glass or metal spacing member (5) encircling the wick within the body of fuel at a location above the base region of the fuel (1*b*). The spacing member (5) includes a wick-encircling top portion which limits combustion and thus defines a lower limit of travel of the flame (4) as the fuel is consumed, and vertically extending portion which serves to space the said limit of travel of the flame above the base region of the fuel (1*b*). The flame is thus kept away from direct contact with the glass enclosure (2) and by selecting the desired thermoconductivity of the spacing member (5) the flame will burn at its lower limit of travel for a greater or lesser length of time, depending on the amount of heat that is transferred to the base region of the fuel (1*b*) via the spacing member (5).

14 Claims, 1 Drawing Sheet

LOW BURNING CANDLE

This application is a continuation of application International Application PCT/GB98/03272 filed Nov. 3, 1998, (now abandoned) which designated the U.S., which application specifically incorporated herein by reference, and which application claims foreign priority to GB 9723416.5 filed Nov. 5, 1997.

BACKGROUND OF THE INVENTION

The present invention relates to a candle, which expression herein refers to all forms of lighting and/or heating devices in which absorbent wick means are supported in a body of fuel, the wick means and the body of fuel have corresponding top and base regions, whereby in use the top region of the body of fuel falls as the fuel is consumed and a top portion of the wick means projects from the top region of the body of fuel to serve as a combustion station at which fuel conveyed by the wick means from the body of fuel is combusted to create a flame for lighting and/or heating. The fuel is typically solid at room temperature, but melts in the vicinity of the flame. The projecting top portion of the wick is itself combusted by the flame and thereby maintains a projecting length, which is typically approximately constant, serving as the combustion station as the body of fuel is consumed.

Wax candles have been known for many centuries. In recent times, air modifying agents such as fragrances have been incorporated into the fuel, with the result that the agent is released into the atmosphere when the candle is used. Still further, in recent times the traditional wax fuels have been replaced in some cases by oil-based fuels, which typically contain an amount of a combustible polymer such as a triblock copolymer (e.g. KRATON (TM)) to solidify the hydrocarbon oil at room temperature.

It has long been known to bound the base region of the body of fuel by an enclosure ("candle holder") during use, to restrict dripping of the molten fuel. However, it has also become common in recent times for at least the base region of the body of fuel to be permanently bounded by an enclosure, with the additional purpose of simplifying the manufacturing process. The enclosure suitably comprises a base wall and optionally a side wall. The enclosure may, for example, be of metal or glass. During manufacture, the base end of the wick is anchored to the central region of the base wall and the wick is held taut. The fuel is then introduced around the wick in heated, liquid, form and allowed to solidify by cooling.

Such known devices suffer from the general disadvantage that their low-burning performance is rather poor. Typically, a certain amount of the fuel may be left unconsumed after the wick has been combusted. Moreover, in some cases there can be a risk of metal parts of the enclosure overheating as the flame burns low, which can potentially lead to uncontrolled flash ignition of the fuel and/or heat damage to the enclosure or any structure on which the arrangement is standing.

SUMMARY OF THE INVENTION

The present invention aims to go at least some way towards overcoming the above disadvantages to provide an improved or at least alternative low-burning candle.

According to the present invention, therefore, there is provided a candle comprising:

a body of fuel having top and base regions thereof;

absorbent wick means supported within the body of fuel and having top and base regions corresponding to the top and base regions or the body of fuel, whereby in use the top region of the body of fuel falls as the fuel is consumed and a top portion of the wick means projects from the top region of the body of fuel to serve as a combustion station at which fuel conveyed by the wick means from the body of fuel is combusted to create a flame; and a spacing member comprising a first portion which substantially encircles the wick means at a location within the body of fuel above the base regions of the wick means and the body of fuel to define a lower limit of travel of the combustion station as the body of fuel is consumed and a second portion which extends below the first portion whereby the said lower limit of the combustion station is spaced above the base region of the body of fuel.

The spacing member may be thermoinsulative or thermoconductive. When relatively thermoinsulative, it may conveniently be made from glass and will function to stop the travel of the flame at a distance above the base region of the body of fuel. In due course the flame will die as the heat of the flame cannot be used to maintain the fuel in a melted condition. However, in practice it is found that the heat of the flame is sufficient to melt the fuel to a depth of about 1 cm below the flame and this molten fuel is available for combustion. When eventually the flame dies, this prevents the heat of the flame acting upon any enclosure present around the body of fuel or upon any structure on which the candle is standing. Between the time of the flame reaching its lower limit of travel and its dying, the solid fuel underlying any molten fuel near the flame acts as a heat sink and thus helps to keep the base region of the body of fuel and any surrounding enclosure cooler than would be the case with conventional candles.

When the spacing member is relatively thermoconductive, it may conveniently be made from metal and will function to stop the travel of the flame at a distance above the base region of the body of fuel, while still allowing the flame to burn and allowing some of the heat of the flame to be conducted by the second portion of the spacing member to warm the base region of the body of fuel, so creating a molten pool of fuel around, and in contact with, the base region of the wick. For this purpose, the second portion of the spacing member will be in thermal contact with the body of fuel. Furthermore, it will be understood that the spacing member must be configured or arranged so that the molten fuel can contact the base region of the wick during low burning. By so conducting heat to the base region of the body of fuel while maintaining the flame spaced above the base region of the body of fuel, the efficiency of melting of the base region of the body of fuel can be maintained or improved compared with known candles, while local overheating of any part of the base region of the body of fuel, or of any enclosure in contact with the base region of the body of fuel, can be restricted or prevented.

The spacing member thus serves to keep the flame away from direct contact with the base of the candle. Moreover, by selecting a desired degree of thermoconductivity of the spacing member, the flame will burn at its lower limit of travel for a greater or lesser length of time, depending on the amount of heat that is transferred to the base region of the fuel via the spacing member.

In the candle of the present invention, the risk of the low-burning candle flame igniting debris such as half-burned matches or pieces of wick which may have collected around the base of the wick is substantially reduced or eliminated.

The first portion of the spacing member is suitably a collar encircling (suitably closely) the wick. The second portion of the spacing member is suitably a downward extension of the collar of the first portion. The member preferably takes the form of a sleeve overlying the base region of the wick means. The sleeve may suitably have an internal diameter about 5% to about 200% more than the width of the wick. In the case of a typical wick width of about 2 mm to about 3 mm, the sleeve may suitably have an internal diameter of about 3 mm to about 8 mm, most suitably about 5 mm. The sleeve may suitably have a length of about 1 cm to 4 cm, most suitably about 2 cm, although this will vary (in ways which will be readily apparent to those of ordinary skill in this art) according to the overall dimensions of the candle and how low the end flame is desired to burn.

The wick is suitably constructed from conventional wick A material, for example cotton.

The fuel is suitably a conventional fuel such as wax or a hydrocarbon oil/polymer mix. Most preferably the fuel is solid at room temperature, but melts under the heat of the flame. A fragrance may suitably be incorporated, for example at levels of up to about 5 to 10% by weight. A suitable hydrocarbon oil/polymer mix consists of an approximately 9:1 by weight mixture of carnation oil and KRATON (TM) (Shell) triblock copolymer.

The body of fuel is suitably bounded by an enclosure which preferably comprises a receptacle (e.g. a bowl) having a base and a side wall. The enclosure is suitably of glass.

The candle according to the invention is manufactured by conventional methods, except that the spacing member is applied to overlie the wick means before the wick means is supported in the body of fuel. In the case of the preferred arrangement in which the fuel is solid at room temperature and the body of fuel is bounded by a glass bowl, for example, the base end of the wick is suitably first provided with a metal sustainer or collar flange which is crimped onto the base end of the wick and the flange part glued to the central region of the base of the bowl. The sleeve (or other member, if another configuration is to be used) is then fitted over the collar (or "nose") of the sustainer to overlie the base region of the wick. There may be a gap at the lower end of the sleeve sufficient to allow molten fuel to enter the sleeve during low burning. The wick is then extended to be taut and the fuel is introduced as a molten liquid which then sets on cooling within the bowl and embeds the wick and spacing sleeve within its mass.

The invention prevents the flame from burning fully down. By placing the spacing member over the base of the wick, the flame burns down to the top of the spacing member but no further. Sufficient heat is transferred down the member to maintain a molten pool of fuel around the base of the wick, the pool being deeper the more thermoconductive the spacing m ember but still appreciable even with a relatively thermoinsulative (e.g. glass) spacing member. This molten fuel is then draw up the wick and ignited to feed the flame in conventional manner. Thus, the present invention can provide in effect a device which functions as a conventional candle until the flame reaches the top of the spacing member, and then optionally as a device similar to an oil burner. Depending on the configuration and thermoconductivity of the second portion of the spacing member, the device can potentially continue to operate until all of the fuel is consumed.

BRIEF DESCRIPTION OF THE FIGURES

For ease of understanding the present invention, and to show how the same fay be put into practice, an embodiment will now be described, purely by way of example and without limitation, with reference to the accompanying drawings, in which.

DESCRIPTION OF THE INVENTION

Figure 1:
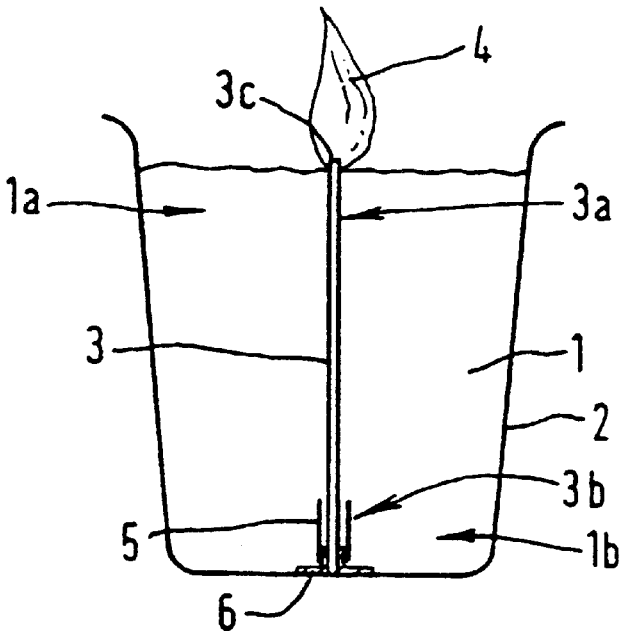
FIG. 1 shows a vertical cross-sectional view through a fragrance candle on first lighting.

Referring to the Figures, in which like parts are designated alike, there is shown a candle including a body of solid fuel 1, which is suitably an approximately 9:1 (by weight) mix of hydrocarbon oil and triblock copolymer (e.g. KRATON (Shell)), and contains a small amount (e.g. about 4%) of a fragrance. The fuel is contained within a glass bowl 2.

The fuel has generally top 1*a* and base 1*b* regions and supports, embedded in its bulk, a wick 3 of a conventional absorbent material such as cotton. The wick has generally top 3*a* and base 3*b* regions corresponding to the top 1*a* and base 1*b* regions of the body of fuel.

In use, a flame 4 is created by igniting a protruding top portion 3*c* of the wick 3. The top portion 1*a* of the body of fuel falls as the fuel is consumed in conventional manner. The wick 3 also burns down in conventional manner so that a top portion of the wick continually projects from the top region of the body of fuel to serve as a combustion station at which fuel conveyed by the wick means from the body of fuel is combusted to create the flame 4.

The candle further includes a glass or metal sleeve member 5 which closely encircles the base region 3*b* of the wick. The sleeve member is conveniently mounted on a conventional metal sustainer 6 fixed to a base of the bowl 2, the sustainer 6 serving primarily to anchor the base region 3*b* of the wick. For this purpose, the sustainer comprises a collar 7 which is crimped to the wick and a flange 8, integral with the collar, which is glued to the base of the bowl 2.

The sleeve member 5 includes a first (top) portion 5*a* which encircles the wick means at a location within the body of fuel 1 above the base regions of the wick 3*b* and the body of fuel 1*b*. That portion Sa defines a lower limit of travel of the combustion station down the wick as the body of fuel is consumed.

The sleeve member 5 also includes a second (lower) portion 5*b* which in the embodiment illustrated is simply an integral extension of the first portion 5*a* and extends is below the first portion in thermal contact with the body of fuel 1.

Figure 2:
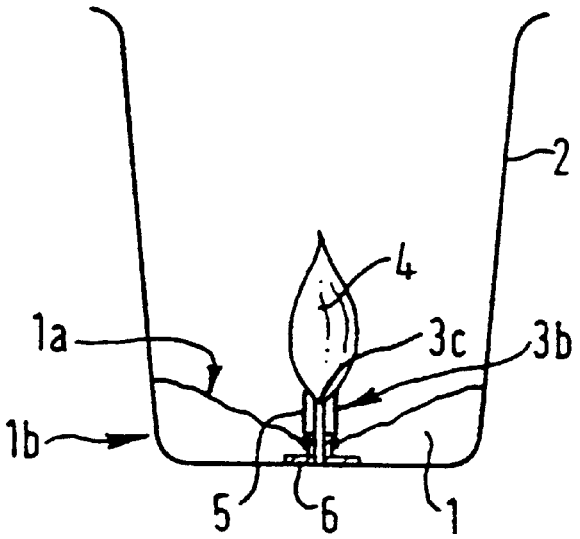
FIG. 2 shows the same view as FIG. 1, but at the end of the life of the candle.
Figure 3:
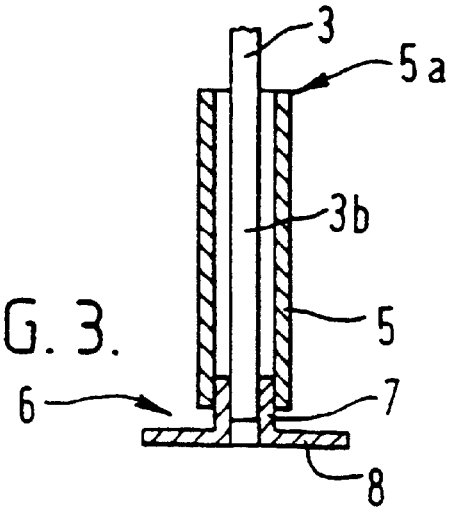
FIG. 3 shows a detail of the base region of the wick of the candle of FIGS. 1 and 2.

When the combustion station reaches its lower limit (FIG. 2), the effect will be somewhat different according to whether the sleeve member 5 is of glass or metal. In the case of a glass sleeve, the flame 4 will be held above the base region 1*b* of the body of fuel and relatively little or no heat will be transferred to the base region 1*b* of the body of fuel or to the bowl 2. A pool of molten fuel up to about 1 cm in depth will form below the flame, which pool will gradually be combusted. The flame 4 will then die as its fuel supply is exhausted.

In the case of a metal sleeve, on the other hand, the flame 4 will be held above the bae region 1*b* of the body of fuel and a certain amount of heat from the flame 4 will be conducted by the sleeve member 5 to the base region 1*b* of the body of fuel.

In both cases, the flame does not enter the top of the sleeve member to any marked extent because once the underside of the flame contacts the upper end of the sleeve member no oxygen can enter the sleeve member to support combustion. The flame instead burns slightly above the upper end of the sleeve member and this gap assists the effect of keeping the heat of the flame away from the base region of the candle.

The sleeve preferably has an internal diameter larger than the external diameter of the crimped collar 7, so that it overlies the collar and is supported in position thereby. However, as will be apparent, it is desirable, particularly when the sleeve is of metal, for molten fuel to gain access to the base of the wick in the sustainer 6. This may be achieved by providing a gap, e.g. between the sleeve 5 and the sustainer 6, so that fuel can flow into the interior of the sleeve.

To manufacture the illustrated candle, the collar 7 of the metal sustainer 6 is crimped in place on the cotton wick 3 and the sleeve member 5 passed over the wick 3 into position on the collar 7. The sustainer 6 is glued to the base of the bowl 2, the flange 8 lying against the bowl as shown. The precise order of the foregoing steps can be changed, as will be apparent to those of skill in this art. The wick 3 is drawn taut and the fuel 1 introduced into the bowl 2 in molten form and allowed to set. The candle can then be ignited, as shown in FIG. 1.

The flame 4 burns down in the manner of a conventional candle and eventually reaches the sleeve 5. The sleeve 5 either then causes the candle to slowly die (glass sleeve) or to function as a fuel burner with the flame 4 being held at the top portion 5*a* of the sleeve (metal sleeve). The sleeve 5 and sustainer 6 are warmed by the flame and molten fuel 1 thereby remains available for absorption into the wick and passing to the flame 4. A metal sleeve results in a larger and longer supply of molter fuel than in the case of a glass sleeve. In the embodiment illustrated, the flange 8 of the sustainer is relatively small; in alternative forms, however, the flange 8 could be larger, which would dissipate the heat of the flame 4 more widely in the case of a metal sleeve, to melt relatively more of the fuel in the base of the bowl 2, so that substantially all of the fuel could be consumed.

The foregoing broadly describes the invention without limitation to particular embodiments. Variations and modification as will be apparent to those of skill in this art are intended to be included within the scope of this application and any resulting patent(s).

I claim:

1. A candle comprising:

a body of fuel having a top region and base a region thereof;

an absorbent wick supported within the body of fuel and having a top and a base region corresponding to the top region and the base region of the body of fuel, whereby in use the top region of the body of fuel falls as the fuel is consumed and a top portion of the wick projects from the top region of the body of fuel to serve as a combustion station at which fuel conveyed by the wick from the body of fuel is combusted to create a flame; and a spacing member comprising a first portion which substantially encircles the wick at a location within the body of fuel above the base regions of the wick and the body of fuel to define a lower limit of travel of the combustion station as the body of fuel is consumed and a second portion which extends below the first portion whereby the said lower limit of travel of the combustion station is spaced above the base region of the body of fuel;

wherein:

(a) the spacing member comprises a sleeve having first and second ends and a sleeve body between the two ends, the first end defining the first portion of the spacing member;

(b) the sleeve engages at its second end a sustainer disposed at the base of the body of fuel which anchors the base region of the wick, whereby the sleeve body defines the second portion of the spacing member, substantially encircles the wick and extends to the sustainer at the base of the body of fuel;

(c) the thermal conductivities of the spacing member and the sustainer are such that fuel at the base region of the body of fuel is melted by the heat of the flame burning at the lower limit of travel of the combustion station; and (d) the spacing member and sustainer are arranged so that molten fuel can contact the base region of the wick while the spacing member remains in position during low burning of the base region of the body of fuel.

2. A candle according to claim 1, wherein the body of fuel is bounded by an enclosure.

3. A candle according to claim 2, wherein the enclosure comprises a receptacle having a base and a side wall.

4. A candle according to claim 1, wherein the fuel comprises wax.

5. A candle according to claim 1, wherein the sleeve is thermoinsulative relative to the sustainer.

6. A candle according to claim 1, wherein the fuel comprises a hydrocarbon oil/polymer mix.

7. A candle according to claim 1, wherein the sleeve comprises glass.

8. A candle according to claim 1, wherein the sustainer comprises metal.

9. A candle according to claim 1, wherein the sleeve has an internal diameter of about 3 mm to about 8 mm.

10. A candle according to claim 1, wherein the sleeve has a length of about 1 cm to about 4 cm.

11. A candle according to claim 1, wherein the sleeve has a length of about 2 cm.

12. A candle according to claim 1, wherein the wick is embedded within the body of fuel.

13. A candle according to claim 12, wherein the body of fuel is the cooled and set form of fuel which was initially brought into contact with the wick as a molten liquid.

14. A candle comprising:

a body of fuel having a top and a base region thereof:

an absorbent wick supported within the body of fuel and having a top and a base region corresponding to the top and base regions of the body of fuel, whereby in use the top region of the body of fuel falls as the fuel is consumed and a top portion of the wick projects from the top region of the body of fuel to serve as a combustion station at which fuel conveyed by the wick from the body of fuel is combusted to create a flame; and a spacing member consisting essentially of a glass sleeve having first and second ends and a sleeve body between the two ends, the sleeve substantially encircling the wick at a location within the body of fuel above the base regions of the wick and the body of fuel, whereby the first end of the sleeve defines a lower limit of travel of the combustion station as the body of fuel is consumed and the sleeve body extends below the first end to space the said lower limit of travel of the combustion station above the base region of the body of fuel; and a metal sustainer disposed at the base of the body of fuel which anchors the base region of the wick, the sleeve engaging the said sustainer at the second end of the sleeve, whereby the sleeve body extends to the sustainer at the base of the body of fuel;

wherein:

(a) the thermal conductivities of the sleeve and the sustainer are such that fuel at the base region of the body of fuel is melted by the heat of the flame burning at the lower limit of travel of the combustion station; and (b) the sleeve and the sustainer are arranged so that molten fuel can contact the base region of the wick while the sleeve remains in position during low burning of the base region of the body of fuel.

* * * * *